US007455941B2

(12) United States Patent
Evans et al.

(10) Patent No.: US 7,455,941 B2
(45) **Date of Patent: *Nov. 25, 2008**

(54) IMAGING MEMBER WITH MULTILAYER ANTI-CURL BACK COATING

(75) Inventors: Kent J. Evans, Lima, NY (US); Robert C. U. Yu, Webster, NY (US); Stephen T. Avery, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 348 days.

This patent is subject to a terminal disclaimer.

(21) Appl. No.: 11/314,507

(22) Filed: Dec. 21, 2005

(65) Prior Publication Data

US 2007/0141493 A1 Jun. 21, 2007

(51) Int. Cl.
*G03G 5/10* (2006.01)

(52) U.S. Cl. ..... 430/69; 399/159

(58) Field of Classification Search ..... 430/69; 399/159

See application file for complete search history.

(56) References Cited

U.S. PATENT DOCUMENTS

| | | | |
|---|---|---|---|
| 3,121,006 | A | 2/1964 | Middleton et al. |
| 3,820,989 | A | 6/1974 | Rule et al. |
| 3,837,851 | A | 9/1974 | Shattuck et al. |
| 3,895,944 | A | 7/1975 | Weidemann et al. |
| 4,150,987 | A | 4/1979 | Anderson et al. |
| 4,245,021 | A | 1/1981 | Kazami et al. |
| 4,256,821 | A | 3/1981 | Enomoto et al. |
| 4,265,990 | A | 5/1981 | Stolka et al. |
| 4,278,746 | A | 7/1981 | Goto et al. |
| 4,286,033 | A | 8/1981 | Neyhart et al. |
| 4,291,110 | A | 9/1981 | Lee |
| 4,297,426 | A | 10/1981 | Sakai et al. |
| 4,315,982 | A | 2/1982 | Ishikawa et al. |
| 4,338,387 | A | 7/1982 | Hewitt |
| 4,338,388 | A | 7/1982 | Sakai et al. |
| 4,385,106 | A | 5/1983 | Sakai |
| 4,387,147 | A | 6/1983 | Sakai |
| 4,399,207 | A | 8/1983 | Sakai et al. |
| 4,399,208 | A | 8/1983 | Takasu et al. |
| 4,587,189 | A | 5/1986 | Hor et al. |
| 4,654,284 | A | 3/1987 | Yu et al. |
| 4,664,995 | A | 5/1987 | Horgan et al. |
| 4,988,597 | A | 1/1991 | Spiewak et al. |
| 5,021,309 | A | 6/1991 | Yu |
| 5,069,993 | A | 12/1991 | Robinette et al. |
| 5,756,245 | A | 5/1998 | Esteghamatian et al. |
| 5,919,590 | A | 7/1999 | Yu et al. |
| 6,124,514 | A | 9/2000 | Emmrich et al. |
| 6,214,514 | B1 | 4/2001 | Evans et al. |
| 6,528,226 | B1 | 3/2003 | Yu et al. |
| 2007/0059623 | A1 * | 3/2007 | Yu ..... 430/69 |

OTHER PUBLICATIONS

Borsenberger, Paul M. et al. Organic Photorteceptors for Imaging Systems. New York: Marcel-Dekker, Inc. (1993) pp. 6-17.*

* cited by examiner

*Primary Examiner*—Christopher RoDee
(74) *Attorney, Agent, or Firm*—Eugene O. Palazzo; Fay Sharpe LLP

(57) ABSTRACT

An imaging member having an anti-curl back coating comprising an inner layer and an outer layer is disclosed. The outer layer comprises a low surface energy polymer having siloxane segments in its backbone and the inner layer comprises a film forming polymer. The anti-curl back coating has low surface energy and improved surface lubricity.

4 Claims, 2 Drawing Sheets

IMAGING MEMBER WITH MULTILAYER ANTI-CURL BACK COATING

CROSS-REFERENCE TO CO-PENDING APPLICATIONS

The present application is related to commonly assigned U.S. patent applications entitled "ANTICURL BACKING LAYER FOR ELECTROSTATOGRAPHIC IMAGING MEMBERS," U.S. Ser. No. 11/199,842, filed on Aug. 9, 2005; "ANTICURL BACK COATING LAYER FOR ELECTROPHOTOGRAPHIC IMAGING MEMBERS," U.S. Ser. No. 11/227,639, filed on Sep. 15, 2005; and "IMAGING MEMBER," U.S. Ser. No. 11/313,985, filed on Dec. 21, 2005. These three applications are fully incorporated herein by reference.

BACKGROUND

This disclosure relates, in various embodiments, to electrostatographic imaging members. The imaging members described herein are flexible electrostatographic imaging members which can be used as photosensitive members, photoreceptors or photoconductors useful in electrophotographic systems, including printers, copiers, other reproductive devices, and digital apparatuses. More particularly, the imaging members of this disclosure have an anti-curl back coating (ACBC) comprising two or more layers or sublayers, including an inner layer and an outer layer. The outer layer includes a low surface energy polymer comprising a small amount of siloxane segments in its molecular backbone.

Flexible electrostatographic imaging members are well known in the art. Typical flexible electrostatographic imaging members include, for example: (1) electrophotographic imaging member belts (photoreceptors) commonly utilized in electrophotographic (xerographic) processing systems; (2) electroreceptors such as ionographic imaging member belts for electrographic imaging systems; and (3) intermediate toner image transfer members such as an intermediate toner image transferring belt which is used to remove a toner image from a photoreceptor surface and transfer the same image onto a receiving substrate, such as paper. The flexible electrostatographic imaging members may be seamless or seamed belts; seamed belts are usually formed by cutting a rectangular sheet from a web, overlapping opposite ends, and ultrasonically welding the overlapped ends together to form a welded seam. Typical electrophotographic imaging member belts include a charge transport layer and a charge generating layer on one side of a supporting substrate layer and an anti-curl back coating (ACBC) layer coated onto the opposite side of the substrate layer. An electrographic imaging member belt may, however, have a more simple material structure; it may have a dielectric imaging layer on one side of a supporting substrate and an ACBC layer on the opposite side of the substrate to render flatness. Although the scope of the present disclosure covers the preparation of all types of flexible electrostatographic imaging members, for reasons of simplicity, the discussion hereinafter will focus only on flexible electrophotographic imaging members in a flexible seamed belt configuration.

Electrophotographic imaging members, such as photoreceptors or photoconductors, typically include a photoconductive layer formed on a flexible electrically conductive substrate or formed on layers between the substrate and photoconductive layer. The photoconductive layer is an insulator in the dark, so that during machine imaging processes, electric charges are retained on its surface. Upon exposure to light, the charge is dissipated, and an image can be formed thereon, developed using a developer material, transferred to a copy substrate, and fused thereto to form a copy or print.

One type of composite photoconductive layer used in xerography is illustrated in U.S. Pat. No. 4,265,990, the disclosure of which is fully incorporated herein by reference, which describes a photosensitive member having at least two electrically operative layers. One layer comprises a photoconductive layer which is capable of photogenerating holes and injecting the photogenerated holes into a contiguous charge transport layer (CTL). Generally, where the two electrically operative layers are supported on a conductive layer, the photoconductive layer is sandwiched between a contiguous CTL and the supporting conductive layer. Alternatively, the CTL may be sandwiched between the supporting electrode and a photoconductive layer. Photosensitive members having at least two electrically operative layers, as disclosed above, provide excellent electrostatic latent images when charged in the dark with a uniform negative electrostatic charge, exposed to a light image and thereafter developed with finely divided electroscopic marking particles. The resulting toner image is usually transferred to a suitable receiving member such as paper or to an intermediate transfer member which thereafter transfers the image to a receiving member such as paper.

In the case where the charge-generating layer (CGL) is sandwiched between the outermost exposed CTL and the electrically conducting layer, the outer surface of the CTL is charged negatively and the conductive layer is charged positively. The CGL then should be capable of generating electron hole pairs when exposed image wise and inject only the holes through the CTL. In the alternate case when the CTL is sandwiched between the CGL and the conductive layer, the outer surface of the CTL is charged positively while the conductive layer is charged negatively and the holes are injected from the CGL to the CTL. The CTL should be able to transport the holes with as little trapping of charge as possible. In a flexible web-like photoreceptor, the electrically conducting layer may be a thin coating of metal on a flexible substrate support layer.

However, as more advanced, higher speed electrophotographic copiers, duplicators and printers have been developed, degradation of image quality has been encountered during extended cycling. The complex, highly sophisticated duplicating and printing systems operating at very high speeds have placed stringent requirements including narrow operating limits on photoreceptors. For example, the numerous layers used in many modern photoconductive imaging members must be highly flexible, adhere well to adjacent layers, and exhibit predictable electrical characteristics within narrow operating limits to provide excellent toner images over many thousands of cycles. One type of multilayered photoreceptor that has been employed as a belt in electrophotographic imaging systems comprises a substrate, a conductive layer, an optional blocking layer, an optional adhesive layer, a charge generating layer (CGL), a charge transport layer (CTL) and a conductive ground strip layer adjacent to one edge of the imaging layers, and an optional overcoat layer adjacent to another edge of the imaging layers. Such a photoreceptor usually further comprises an anti-curl back coating (ACBC) layer on the side of the substrate opposite the side carrying the conductive layer, support layer, blocking layer, adhesive layer, charge generating layer, charge transport layer and other layers, in order to provide the photoreceptor with the desired flatness.

Typical negatively-charged imaging member belts, such as flexible photoreceptor belt designs, are made of multiple layers comprising a flexible supporting substrate, a conductive ground plane, a charge blocking layer, an optional adhesive layer, a charge generating layer (CGL), a charge transport layer (CTL). The CTL is usually the last layer to be coated and is applied by solution coating then followed by drying the wet applied coating at elevated temperatures of about 115° C., and finally cooling it down to ambient room temperature of about 25° C. When a production web stock of coated multilayered photoreceptor material is obtained, upward curling of the multilayered photoreceptor can be observed. This upward curling is a consequence of thermal contraction mismatch between the CTL and the substrate support. As the web stock carrying the wet applied CTL is dried at an elevated temperature, dimensional contraction occurs as the solvent evaporates. Because the drying temperature is usually above the glass transition temperature of the CTL, the CTL remains as a viscous solvent and will flow, automatically re-adjusting itself to compensate for the loss of solvent and maintain its dimensions. As the CTL cools down to its Tg, it solidifies and adheres to the CGL. Further cooling of the CTL down to ambient room temperature will then cause the CTL to contract more than the substrate support layer since it has a thermal coefficient of dimensional contraction approximately 3.7 times greater than that of the substrate support. This differential causes tension strain to develop in the CTL; if unrestrained at this point, the imaging member web stock will thereby spontaneously curl upwardly into a 1.5-inch tube. To offset the curling, an anti-curl back coating (ACBC) layer is applied to the backside of the flexible substrate support, opposite to the side having the charge transport layer, to render the web stock flat.

In this regard, curling of a photoreceptor web is undesirable because it hinders fabrication of the web into cut sheets and subsequent welding into a belt. Although the ACBC layer counters and balances the curl so as to promote flatness, nonetheless typical conventional ACBC formulations, under normal machine functioning conditions, do not always provide satisfactory imaging member belt performance. For example, ACBC wear and electrostatic charging-up are two frequently seen failures which reduce the service life of a belt and require costly belt replacement.

ACBC layer wear also reduces the ACBC layer thickness, causing the imaging member belt to curl upward. Thinning of the ACBC layer results in reduction of its counter-curling force. Curling is undesirable during imaging belt function because different segments of the imaging surface of the belt are then located at different distances from charging devices, causing non-uniform charging and other problems. For example, non-uniform charging distances can manifest as variations in high background deposits during development of electrostatic latent images near the edges of paper.

The ACBC layer is an outermost exposed backing layer and has high surface contact friction when it slides over the machine subsystems of belt support module, such as rollers, stationary belt guiding components, and backer bars, during dynamic belt cyclic function. These mechanical sliding interactions against the belt support module components not only exacerbate ACBC layer wear, they also produce debris which scatters and deposits on critical machine components such as lenses, corona charging devices and the like, thereby adversely affecting machine performance.

Moreover, high contact friction of the ACBC layer against machine subsystems causes electrostatic charge build-up. This increases the friction and thus requires more torque to pull the belt. In full color machines with 10 pitches the torque can be extremely high due to large number of backer bars used. At times, one has to use two drive rollers rather than just one, which must then be coordinated electronically precisely to keep any possibility of sagging. Static charge build-up in the ACBC has also been found to result in absolute belt stalling, resulting in machine shutdown. In other cases, the electrostatic charge build-up can be so high as to cause sparking and arcing.

Another problem encountered in conventional belt photoreceptors is an audible squeaky sound generated due to high contact friction interaction between the ACBC layer and the backer bars. Moreover, cumulative deposition of ACBC layer wear debris onto the backer bars may give rise to undesirable defect print marks formed on copies because each debris deposit becomes a surface protrusion point on the backer bar and locally forces the imaging member belt upwardly to interfere with the toner image development process. On other occasions, the ACBC layer wear debris accumulation on the backer bars gradually increases the dynamic contact friction between these two interacting surfaces, interfering with the driving motor to a point where the motor eventually stalls and belt cycling prematurely ceases.

One known method of reducing ACBC layer wear is by including organic particles such as polytetrafluoroethylene (PTFE) into the polymer binder to reinforce the ACBC layer. The benefit of this formulation, however, is outweighed by a major drawback in the PTFE particle dispersion stability of the coating solution. PTFE, being two times heavier than the coating solution, forms an unstable dispersion in a polymer coating solution and tends to settle into big agglomerates in the mix tanks if not continuously stirred. The dispersion problem can result in an ACBC with an insufficient, variable, and/or inhomogeneous PTFE dispersion along the length of the coated web, which inadequately reduces friction. Therefore, the production of an ACBC eliminating or minimizing these difficulties, is needed.

Incorporation by Reference

The following patents, the disclosures of which are incorporated in their entireties by reference, are mentioned.

In U.S. Pat. No. 5,919,590, preparation of a flexible electrophotographic imaging member containing an improved anti-curl layer is disclosed. The electrophotographic imaging member comprising a support substrate having an electrically conductive layer, at least one imaging layer, an anti-curl layer, an optional ground strip layer, and an optional overcoating layer; the anti-curl layer including a film forming polycarbonate binder, an optional adhesion promoter, and a liquid siloxane additive.

U.S. Pat. No. 5,069,993, an exposed layer in an electrophotographic imaging member is provided with increased resistance to stress cracking and reduced coefficient of surface friction, without adverse effects on optical clarity and electrical performance. The layer contains a polymethylsiloxane copolymer and an inactive film forming resin binder. Various specific film forming resins for the anti-curl layer and adhesion promoters are disclosed.

U.S. Pat. No. 5,021,309, shows an electrophotographic imaging device, with material for an exposed anti-curl layer having organic fillers dispersed therein. The fillers reduce the coefficient of surface contact friction, increase wear resistance, and improve adhesion of the anti-curl layer, without adversely affecting the optical and mechanical properties of the imaging member.

U.S. Pat. No. 5,021,309 shows an electrostatographic imaging member comprising a supporting substrate having an electrically conductive layer, at least one imaging layer, an anti-curl layer, an optional ground strip layer and an optional overcoat layer, the anti-curl layer including a film forming polycarbonate binder, an optional adhesion promoter, and optional dispersed particles selected from the group consisting of organic particles, and mixtures thereof.

In U.S. Pat. No. 4,654,284, an electrophotographic imaging member is disclosed comprising a flexible support substrate layer having an anti-curl layer, the anti-curl layer comprising a film forming binder, crystalline particles dispersed in the film forming binder and a reaction product of a bifunctional chemical coupling agent with both the binder and the crystalline particles. The use of VITEL PE 100 in the anti-curl layer is described.

In U.S. Pat. No. 6,528,226, a process for preparing an imaging member is disclosed that includes applying an organic layer to an imaging member substrate, treating the organic layer and/or a backside of the substrate with a corona discharge effluent, and applying an overcoat layer to the organic layer and/or an ACBC to the backside of the substrate.

While the above mentioned flexible imaging members may be useful for their intended purpose of resolving specific problems, resolution of one problem has nonetheless often created new ones. Consequently, there continues to be a need for improvements in such systems, particularly for an imaging member belt that includes a functionally improved ACBC layer having one or more of the following features: sufficiently counters curling to render flatness; reduces surface contact friction; has superb wear resistance; provides lubricity to ease belt drive; little or no wear debris; and eliminates the electrostatic charge build-up problem.

BRIEF DESCRIPTION

Disclosed herein, in various exemplary embodiments, is an imaging member having an improved ACBC coating that addresses one or more of the, shortcomings of traditional ACBC coatings discussed above. Also disclosed herein are processes for providing imaging members having such an ACBC coating and methods of imaging utilizing such imaging members.

In embodiments, the imaging member comprises an ACBC coating having at least an inner layer and an outer layer. The outer layer comprises a low surface energy polymer having siloxane segments in its backbone. In other embodiments, the outer layer also includes a further film forming polymer. In further embodiments, the low surface energy polymer is selected from specific polycarbonates. In additional embodiments, the outer layer comprises the low surface energy polymer and no other polymers.

Also disclosed is an image forming apparatus having an imaging member as described above, as well as a process for using such an apparatus to form an image.

These and other non-limiting features and/or characteristics of the embodiment of this disclosure are more particularly disclosed below.

BRIEF DESCRIPTION OF THE DRAWINGS

The following is a brief description of the drawings, which are presented for the purposes of illustrating the exemplary embodiments disclosed herein and not for the purposes of limiting the same.

DETAILED DESCRIPTION

Figure 1:
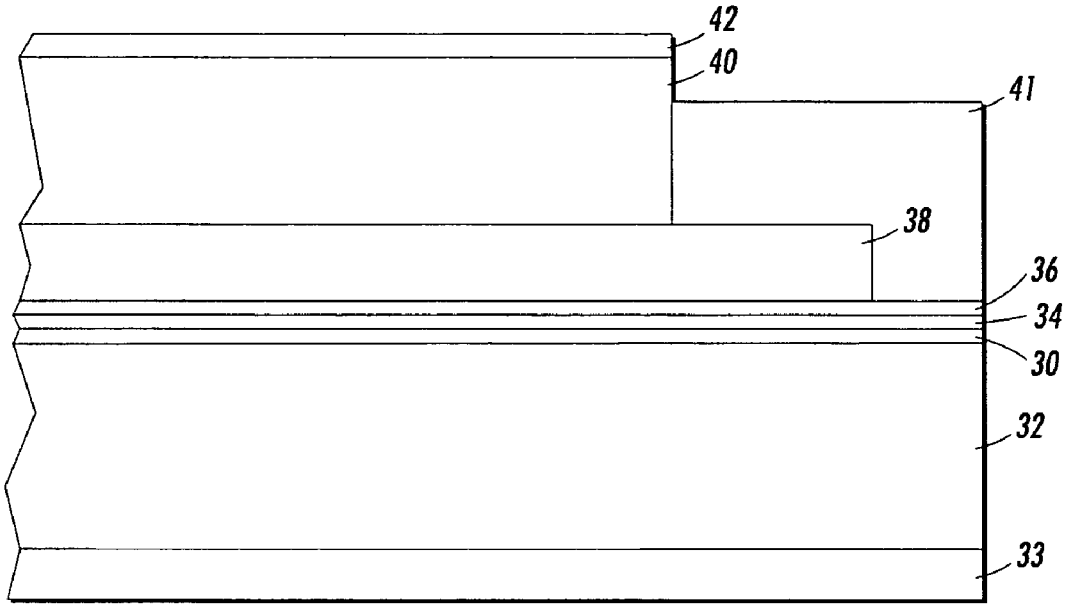
FIG. 1 is a cross-sectional view of a typical conventional multilayered electrophotographic imaging member.

The exemplary embodiments of this disclosure are more particularly described below with reference to the drawings. Although specific terms are used in the following description for clarity, these terms are intended to refer only to the particular structure of the various embodiments selected for illustration in the drawings and not to define or limit the scope of the disclosure. The same reference numerals are used to identify the same structure in different Figures unless specified otherwise. The structures in the Figures are not drawn according to their relative proportions and the drawings should not be interpreted as limiting the disclosure in size or location. It is understood that other embodiments may be utilized and structural and operational changes may be made without departing from the scope of the present disclosure.

A typical negatively charged flexible electrophotographic imaging member is illustrated in FIG. 1. The substrate 32 has an optional conductive layer 30. An optional hole blocking layer 34 can also be applied, as well as an optional adhesive layer 36. The charge generating layer 38 is located between the substrate 32 and the charge transport layer 40. An optional ground strip layer 41 operatively connects the charge generating layer 38 and the charge transport layer 40 to the conductive layer 30. An optional overcoat layer 42 is present. An ACBC coating or layer 33 is applied to the side of the substrate 32 opposite from the electrically active layers.

Other layers of the imaging member include, for example, an optional ground strip layer 41, applied to one edge of the imaging member to promote electrical continuity with the conductive layer 30 through the hole blocking layer 34. A conductive ground plane layer 30, which is typically a thin metallic layer, for example a 10 nanometer thick titanium coating, may be deposited over the substrate 32 by vacuum deposition or sputtering process. The layers 34, 36, 38, 40 and 42 may be separately and sequentially deposited, onto the surface of conductive ground plane 30 of substrate 32, as wet coating layer of solutions comprising a solvent, with each layer being dried before deposition of the next. Anti-curl back coating 33 is also solution coated, but is applied to the back side (the side opposite to all the other layers) of substrate 32, to render the imaging member flat.

Figure 2:
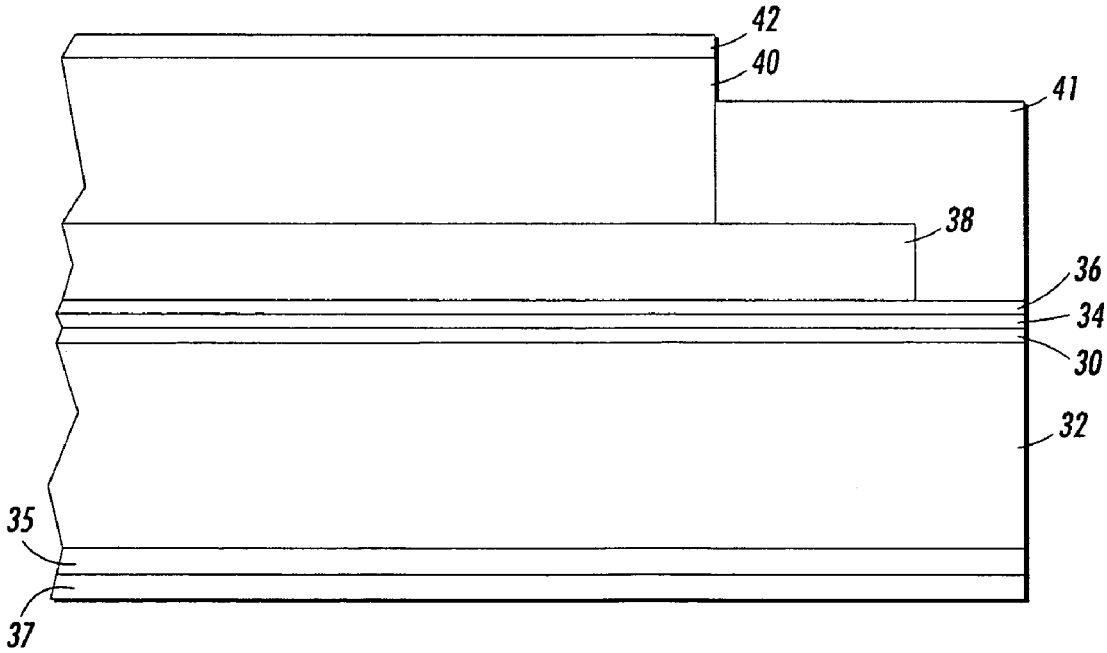
FIG. 2 is a cross-sectional view of a multilayered electrophotographic imaging member according to an embodiment of the present disclosure.

An imaging member containing the ACBC coating or layer of the present disclosure is illustrated in FIG. 2. The inner layer or sublayer 35 is coated over by the outer layer or sublayer 37. The layers are defined in reference to the substrate 32; thus, the outer layer is the outermost layer and is the layer exposed to the machine environment.

Figure 3:
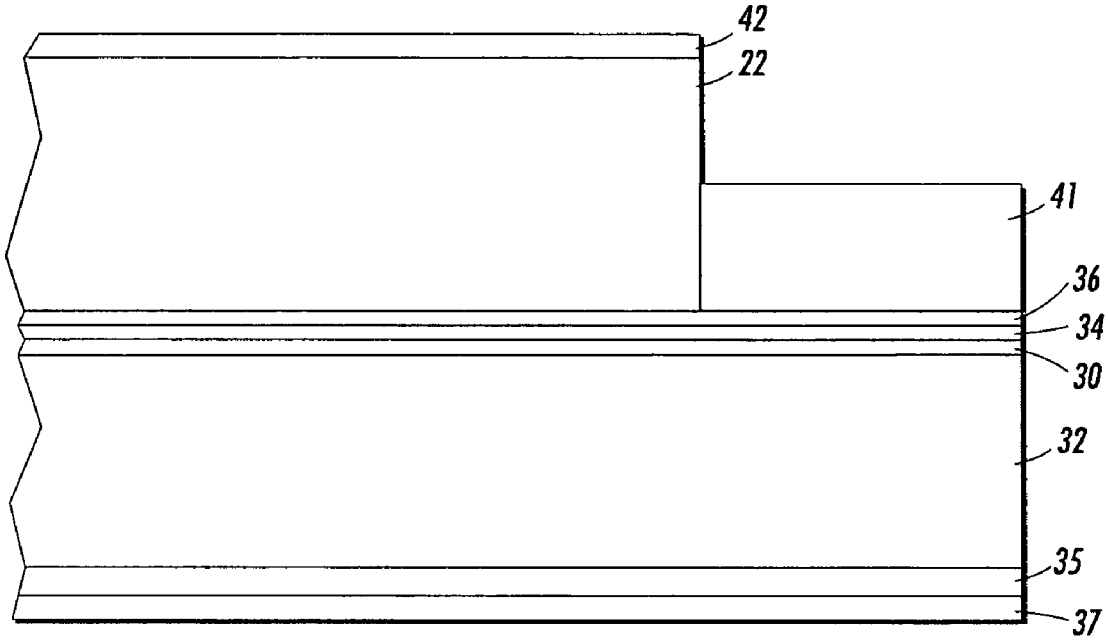
FIG. 3 is a cross-sectional view of a multilayered electrophotographic imaging member according to the description of a further embodiment of the present disclosure.

As an alternative to the discrete charge transport layer 40 and charge generating layer 38, a simplified single imaging layer 22, as shown in FIG. 3, having both charge generating and charge transporting capability, may be employed. The single imaging layer 22 may comprise a single electrophotographically active layer capable of retaining an electrostatic charge in the dark during electrostatic charging, imagewise exposure and image development, as disclosed, for example, in U.S. application Ser. No. 10/202,296, filed Jul. 23, 2002, the disclosure of which is fully incorporated herein by reference. The single layer incorporates both photogenerating material and charge transport component as described in reference to each separate layer below.

The Substrate

The photoreceptor support substrate 32 may be opaque or substantially transparent, and may comprise any suitable organic or inorganic material having the requisite mechanical properties. The substrate may comprise the same material as that in the electrically conductive surface, or the electrically conductive surface can be merely a coating on the substrate. Any suitable electrically conductive material can be employed. Typical electrically conductive materials include copper, brass, nickel, zinc, chromium, stainless steel, conductive plastics and rubbers, aluminum, semitransparent aluminum, steel, cadmium, silver, gold, zirconium, niobium, tantalum, vanadium, hafnium, titanium, nickel, chromium, tungsten, molybdenum, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. It could be single metallic compound or dual layers of different metals and or oxides.

The substrate can also be formulated entirely of an electrically conductive material, or it can be an insulating material including inorganic or organic polymeric materials, such as, MYLAR, a commercially available biaxially oriented polyethylene terephthalate from DuPont, or polyethylene naphthalate available as KADALEX 2000, with a conductive layer comprising a conductive titanium or titanium/zirconium coating, otherwise a layer of an organic or inorganic material having a semiconductive surface layer, such as indium tin oxide, aluminum, titanium, and the like, or exclusively be made up of a conductive material such as, aluminum, chromium, nickel, brass, other metals and the like. The thickness of the support substrate depends on numerous factors, including mechanical performance and economic considerations. The substrate may have a number of many different configurations, such as, for example, a plate, a drum, a scroll, an endless flexible belt, and the like. In one embodiment, the substrate is in the form of a seamed flexible belt.

The thickness of the substrate depends on numerous factors, including flexibility, mechanical performance, and economic considerations. The thickness of the support substrate may range from about 50 micrometers to about 3,000 micrometers. In embodiments of flexible photoreceptor belt preparation, the thickness of substrate is from about 50 micrometers to about 200 micrometers for optimum flexibility and to effect minimum induced photoreceptor surface bending stress when a photoreceptor belt is cycled around small diameter rollers in a machine belt support module, for example, 19 millimeter diameter rollers.

An exemplary substrate support is not soluble in any of the solvents used in each coating layer solution, is optically transparent, and is thermally stable up to a high temperature of about 150° C. A typical substrate support used for imaging member fabrication has a thermal contraction coefficient ranging from about $1\times10^{-5}$/° C. to about $3\times10^{-5}$/° C. and a Young's Modulus of between about $5\times10^{-5}$ psi ($3.5\times10^{-4}$ Kg/cm$^2$) and about $7\times10^{-5}$ psi ($4.9\times10^{-4}$ Kg/cm$^2$).

The Conductive Layer

The conductive ground plane layer 30 may vary in thickness depending on the optical transparency and flexibility desired for the electrophotographic imaging member. When a photoreceptor flexible belt is desired, the thickness of the conductive layer on the support substrate typically ranges from about 2 nanometers to about 75 nanometers to enable adequate light transmission for proper back erase, and in embodiments from about 10 nanometers to about 20 nanometers for an optimum combination of electrical conductivity, flexibility, and light transmission. Generally, for rear erase exposure, a conductive layer light transparency of at least about 15 percent is desirable. The conductive layer need not be limited to metals. The conductive layer may be an electrically conductive metal layer which may be formed, for example, on the substrate by any suitable coating technique, such as a vacuum depositing or sputtering technique. Typical metals suitable for use as conductive layer include aluminum, zirconium, niobium, tantalum, vanadium, hafnium, titanium, nickel, stainless steel, chromium, tungsten, molybdenum, combinations thereof, and the like. Where the entire substrate is an electrically conductive metal, the outer surface thereof can perform the function of an electrically conductive layer and a separate electrical conductive layer may be omitted. Other examples of conductive layers may be combinations of materials such as conductive indium tin oxide as a transparent layer for light having a wavelength between about 4000 Angstroms and about 9000 Angstroms or a conductive carbon black dispersed in a plastic binder as an opaque conductive layer.

The Hole Blocking Layer

A hole blocking layer 34 may then be applied to the substrate or to the conductive layer, where present. Any suitable positive charge (hole) blocking layer capable of forming an effective barrier to the injection of holes from the adjacent conductive layer 30 into the photoconductive or photogenerating layer may be utilized. The charge (hole) blocking layer may include polymers, such as, polyvinylbutyral, epoxy resins, polyesters, polysiloxanes, polyamides, polyurethanes, HEMA, hydroxylpropyl cellulose, polyphosphazine, and the like, or may comprise nitrogen containing siloxanes or silanes, or nitrogen containing titanium or zirconium compounds, such as, titanate and zirconate. The hole blocking layer may have a thickness in wide range of from about 5 nanometers to about 10 micrometers depending on the type of material chosen for use in a photoreceptor design. Typical hole blocking layer materials include, for example, trimethoxysilyl propylene diamine, hydrolyzed trimethoxysilyl propyl ethylene diamine, N-beta-(aminoethyl)gamma-aminopropyl trimethoxy silane, isopropyl 4-aminobenzene sulfonyl di(dodecylbenzene sulfonyl)titanate, isopropyl di(4-aminobenzoyl)isostearoyl titanate, isopropyl tri(N-ethylaminoethylamino)titanate, isopropyl trianthranil titanate, isopropyl tri(N,N-dimethylethylamino)titanate, titanium-4-amino benzene sulfonate oxyacetate, titanium 4-aminobenzoate isostearate oxyacetate, (gamma-aminobutyl)methyl diethoxysilane which has the formula [H2N(CH2)4]CH3Si(OCH3)2, and (gamma-aminopropyl)methyl diethoxysilane, which has the formula [H2N(CH2)3]CH33Si(OCH3)2, and combinations thereof, as disclosed, for example, in U.S. Pat. Nos. 4,338,387; 4,286,033; and 4,291,110, incorporated herein by reference in their entireties. A preferred hole blocking layer comprises a reaction product between a hydrolyzed silane or mixture of hydrolyzed silanes and the oxidized surface of a metal ground plane layer. The oxidized surface inherently forms on the outer surface of most metal ground plane layers when exposed to air after deposition. This combination enhances electrical stability at low RH. Other suitable charge blocking layer polymer compositions are also described in U.S. Pat. No. 5,244,762 which is incorporated herein by reference in its entirety. These include vinyl hydroxyl ester and vinyl hydroxy amide polymers wherein the hydroxyl groups have been partially modified to benzoate and acetate esters which modified polymers are then blended with other unmodified vinyl hydroxy ester and amide unmodified polymers. An example of such a blend is a 30 mole percent benzoate ester of poly (2-hydroxyethyl methacrylate) blended with the parent polymer poly (2-hydroxyethyl methacrylate). Still other suitable charge blocking layer polymer compositions are described in U.S. Pat. No. 4,988,597, which is incorporated herein by reference in its entirety. These include polymers containing an alkyl acrylamidoglycolate alkyl ether repeat unit. An example of such an alkyl acrylamidoglycolate alkyl ether containing polymer is the copolymer poly(methyl acrylamidoglycolate methyl ether-co-2-hydroxyethyl methacrylate). The disclosures of these U.S. patents are incorporated herein by reference in their entireties.

The hole blocking layer can be continuous or substantially continuous and may have a thickness of less than about 10 micrometers because greater thicknesses may lead to undesirably high residual voltage. In aspects of the exemplary embodiment, a blocking layer of from about 0.005 micrometers to about 2 micrometers gives optimum electrical performance. The blocking layer may be applied by any suitable conventional technique, such as, spraying, dip coating, draw bar coating, gravure coating, silk screening, air knife coating, reverse roll coating, vacuum deposition, chemical treatment, and the like. For convenience in obtaining thin layers, the blocking layer may be applied in the form of a dilute solution, with the solvent being removed after deposition of the coating by conventional techniques, such as, by vacuum, heating, and the like. Generally, a weight ratio of blocking layer material and solvent of between about 0.05:100 to about 5:100 is satisfactory for spray coating.

The Adhesive Interface Layer

An optional separate adhesive interface layer 36 may be provided. The adhesive interface layer may include a copolyester resin. Exemplary polyester resins which may be utilized for the interface layer include polyarylatepolyvinylbutyrals, such as ARDEL POLYARYLATE (U-100) commercially available from Toyota Hsutsu Inc., VITEL PE-1200, VITEL PE-2200, VITEL PE-2200D, and VITEL PE-2222, all from Bostik, 49,000 polyester from Rohm Haas, polyvinyl butyral, and the like. The adhesive interface layer may be applied directly to the hole blocking layer. Thus, the adhesive interface layer in some embodiments is in direct contiguous contact with both the underlying hole blocking layer and the overlying charge generating layer to enhance adhesion bonding to provide linkage. In yet other embodiments, the adhesive interface layer is entirely omitted.

Any suitable solvent or solvent mixtures may be employed to form a coating solution of the polyester for the adhesive interface layer. Typical solvents include tetrahydrofuran, toluene, monochlorbenzene, methylene chloride, cyclohexanone, and the like, and mixtures thereof. Any other suitable and conventional technique may be used to mix and thereafter apply the adhesive layer coating mixture to the hole blocking layer. Typical application techniques include spraying, dip coating, roll coating, wire wound rod coating, and the like. Drying of the deposited wet coating may be effected by any suitable conventional process, such as oven drying, infra red radiation drying, air drying, and the like.

The adhesive interface layer may have a thickness of from about 0.01 micrometers to about 900 micrometers after drying. In embodiments, the dried thickness is from about 0.03 micrometers to about 1 micrometer.

The Charge Generating Layer

Any suitable charge generating layer (CGL) 38 including a photogenerating or photoconductive material, which may be in the form of particles and dispersed in a film forming binder, such as an inactive resin, may be utilized. Examples of photogenerating materials include, for example, inorganic photoconductive materials such as amorphous selenium, trigonal selenium, and selenium alloys selected from the group consisting of selenium-tellurium, selenium-tellurium-arsenic, selenium arsenide and mixtures thereof, and organic photoconductive materials including various phthalocyanine pigments such as the X-form of metal free phthalocyanine, metal phthalocyanines such as vanadyl phthalocyanine and copper phthalocyanine, hydroxy gallium phthalocyanines, chlorogallium phthalocyanines, titanyl phthalocyanines, quinacridones, dibromo anthanthrone pigments, benzimidazole perylene, substituted 2,4-diamino-triazines, polynuclear aromatic quinones, and the like dispersed in a film forming polymeric binder. Selenium, selenium alloy, benzimidazole perylene, and the like and mixtures thereof may be formed as a continuous, homogeneous photogenerating layer. Benzimidazole perylene compositions are well known and described, for example, in U.S. Pat. No. 4,587,189, the entire disclosure thereof being incorporated herein by reference. Multi-photogenerating layer compositions may be utilized where a photoconductive layer enhances or reduces the properties of the photogenerating layer. Other suitable photogenerating materials known in the art may also be utilized, if desired. The photogenerating materials selected should be sensitive to activating radiation having a wavelength between about 400 and about 900 nm during the imagewise radiation exposure step in an electrophotographic imaging process to form an electrostatic latent image. For example, hydroxygallium phthalocyanine absorbs light of a wavelength of from about 370 to about 950 nanometers, as disclosed, for example, in U.S. Pat. No. 5,756,245.

Any suitable inactive resin materials may be employed as a binder in the photogenerating layer, including those described, for example, in U.S. Pat. No. 3,121,006, the entire disclosure thereof being incorporated herein by reference. Typical organic resinous binders include thermoplastic and thermosetting resins such as one or more of polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl butyral, polyvinyl acetate, polysiloxanes, polyacrylates, polyvinyl acetals, polyamides, polyimides, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride/vinylchloride copolymers, vinylacetate/vinylidene chloride copolymers, styrene-alkyd resins, and the like.

An exemplary film forming polymer binder is PCZ400 (poly(4,4'-dihydroxy-diphenyl-1-1-cyclohexane) which has a MW of 40,000 and is available from Mitsubishi Gas Chemical Corporation.

The photogenerating material can be present in the resinous binder composition in various amounts. Generally, from about 5 percent by volume to about 90 percent by volume of the photogenerating material is dispersed in about 10 percent by volume to about 95 percent by volume of the resinous binder, and more specifically from about 20 percent by volume to about 30 percent by volume of the photo generating material is dispersed in about 70 percent by volume to about 80 percent by volume of the resinous binder composition.

The photogenerating layer containing the photogenerating material and the resinous binder material generally ranges in thickness of from about 0.1 micrometer to about 5 micrometers, for example, from about 0.3 micrometers to about 3 micrometers when dry. The photogenerating layer thickness is generally related to binder content. Higher binder content compositions generally employ thicker layers for photogeneration.

The Ground Strip Layer

Other layers such as conventional ground strip layer 41 comprising, for example, conductive particles dispersed in a film forming binder may be applied to one edge of the imaging member to promote electrical continuity with the conductive layer through the hole blocking layer. The ground strip layer 41 may include any suitable film forming polymer binder and electrically conductive particles and is co-extrusion along during the application of charge transport layer 40 coating. Typical ground strip materials include those enumerated in U.S. Pat. No. 4,664,995, the entire disclosure of which is incorporated by reference herein. The ground strip layer may have a thickness from about 7 micrometers to about 42 micrometers, for example, from about 14 micrometers to about 23 micrometers.

The Charge Transport Layer

The charge transport layer (CTL) 40 is thereafter applied over the CGL and may include any suitable transparent organic polymer or non-polymeric material capable of supporting the injection of photogenerated holes or electrons from the CGL and capable of allowing the transport of these holes/electrons through the CTL to selectively discharge the surface charge on the imaging member surface. In one embodiment, the CTL not only serves to transport holes, but also protects the CGL from abrasion or chemical attack and may therefore extend the service life of the imaging member. The CTL can be a substantially non-photoconductive material, but one which supports the injection of photogenerated holes from the charge generation layer. The CTL is normally transparent in a wavelength region in which the electrophotographic imaging member is to be used when exposure is effected therethrough to ensure that most of the incident radiation is utilized by the underlying CGL. The CTL should exhibit excellent optical transparency with negligible light absorption and neither charge generation nor discharge if any, when exposed to a wavelength of light useful in xerography, e.g., 400 to 900 nanometers. In the case when the photoreceptor is prepared with the use of a transparent substrate and also a transparent conductive layer, image wise exposure or erase may be accomplished through the substrate with all light passing through the back side of the substrate. In this case, the materials of the CTL need not transmit light in the wavelength region of use if the CGL is sandwiched between the substrate and the CTL. The CTL in conjunction with the CGL is an insulator to the extent that an electrostatic charge placed on the CTL is not conducted in the absence of illumination. The CTL should trap minimal charges as they pass through it during the printing process.

The CTL may include any suitable charge transport component or activating compound useful as an additive molecularly dispersed in an electrically inactive polymeric material to form a solid solution and thereby making this material electrically active. The charge transport component may be added to a film forming polymeric material which is otherwise incapable of supporting the injection of photo generated holes from the generation material and incapable of allowing the transport of these holes therethrough. This converts the electrically inactive polymeric material to a material capable of supporting the injection of photogenerated holes from the CGL and capable of allowing the transport of these holes through the CTL in order to discharge the surface charge on the CTL. The charge transport component typically comprises small molecules of an organic compound which cooperate to transport charge between molecules and ultimately to the surface of the CTL.

Any suitable inactive resin binder soluble in methylene chloride, chlorobenzene, or other suitable solvent may be employed in the CTL. Exemplary binders include polyesters, polyvinyl butyrals, polycarbonates, polystyrene, polyvinyl formals, and combinations thereof. The polymer binder used for the CTLs may be, for example, selected from the group consisting of polycarbonates, poly(vinyl carbazole), polystyrene, polyester, polyarylate, polyacrylate, polyether, polysulfone, combinations thereof, and the like. Exemplary polycarbonates include poly(4,4'-isopropylidene diphenyl carbonate), poly(4,4'-diphenyl-1,1'-cyclohexane carbonate), and combinations thereof. The molecular weight of the binder can be for example, from about 20,000 to about 1,500,000. One exemplary binder of this type is a MAKROLON binder, which is available from Bayer AG and comprises poly(4,4'-isopropylidene diphenyl)carbonate having a weight average molecular weight of about 120,000.

Exemplary charge transport components include aromatic polyamines, such as aryl diamines and aryl triamines. Exemplary aromatic diamines include N,N'-diphenyl-N,N'-bis(alkylphenyl)-1,1'-biphenyl-4,4'-diamines, such as m-TBD, which has the formula (N,N'-diphenyl-N,N'-bis[3-methylphenyl]-[1,1'-biphenyl]-4,4'-diamine); N,N'-diphenyl-N,N'-bis(chlorophenyl)-1,1'-biphenyl-4,4'-diamine; and N,N'-bis-(4-methylphenyl)-N,N'-bis(4-ethylphenyl)-1,1'-(3,3'-dimethylbiphenyl)-4,4'-diamine (Ae-16), N,N'-bis(3,4-dimethylphenyl)-4,4'-biphenyl amine (Ae-18), and combinations thereof. Other suitable charge transport components include pyrazolines, such as 1-[lepidyl-(2)]-3-(p-diethylaminophenyl)-5-(p-diethylaminophenyl)pyrazoline, as described, for example, in U.S. Pat. Nos. 4,315,982, 4,278,746, 3,837,851, and 6,214,514, substituted fluorene charge transport molecules, such as 9-(4'-dimethylaminobenzylidene)fluorene, as described in U.S. Pat. Nos. 4,245,021 and 6,214,514, oxadiazole transport molecules, such as 2,5-bis(4-diethylaminophenyl)-1,3,4-oxadiazole, pyrazoline, imidazole, triazole, as described, for example in U.S. Pat. No. 3,895,944, hydrazones, such as p-diethylaminobenzaldehyde (diphenylhydrazone), as described, for example in U.S. Pat. Nos. 4,150,987 4,256,821, 4,297,426, 4,338,388, 4,385,106, 4,387,147, 4,399,207, 4,399,208, 6,124,514, and tri-substituted methanes, such as alkyl-bis(N,N-dialkylaminoaryl) methanes, as described, for example, in U.S. Pat. No. 3,820,989. The disclosures of all of these patents are incorporated herein be reference in their entireties.

The concentration of the charge transport component in the CTL may be from about 5 weight % to about 60 weight % based on the weight of the dried CTL. The concentration or composition of the charge transport component may vary through the CTL, as disclosed, for example, in U.S. application Ser. No. 10/736,864, filed Dec. 16, 2003; U.S. application Ser. No. 10/320,808, filed Dec. 16, 2002, and U.S. application Ser. No. 10/655,882, filed Sep. 5, 2003; the disclosures of which are incorporated herein by reference in their entireties. In one exemplary embodiment, the CTL comprises from about 10 to about 60 weight % of N,N'-diphenyl-N,N'-bis(3-methylphenyl)-1,1'-biphenyl4,4'-diamine. In a more specific embodiment, the CTL comprises from about 30 to about 50 weight % N,N'-diphenyl-N,N'-bis(3-methylphenyl)-1,1'-biphenyl-4,4'-diamine.

The CTL is an insulator to the extent that the electrostatic charge placed on the CTL is not conducted in the absence of illumination at a rate sufficient to prevent formation and retention of an electrostatic latent image thereon. In general, the ratio of the thickness of the CTL to the CGL is maintained from about 2:1 to about 200:1 and in some instances as great as about 400:1.

Additional aspects relate to the inclusion in the CTL of variable amounts of an antioxidant, such as a hindered phenol. Exemplary hindered phenols include octadecyl-3,5-di-tert-butyl4-hydroxyhydrocinnamate, available as IRGANOX I-1010 from Ciba Specialty Chemicals. The hindered phenol may be present at up to about 10 weight percent based on the total weight of the dried CTL. Other suitable antioxidants are described, for example, in above-mentioned U.S. application Ser. No. 10/655,882, which is hereby incorporated by reference.

In specific, the CTL is a solid solution including a charge transport component, such as N,N'-diphenyl-N,N'-bis(3-methylphenyl)-1,1'-biphenyl4,4'-diamine, molecularly dissolved in a polycarbonate binder, the binder being either a poly(4,4'-isopropylidene diphenyl carbonate) or a poly(4,4'-diphenyl-1,1'-cyclohexane carbonate). The CTL may have a Young's Modulus in the range of from about $2.0\times10^5$ psi ($1.7\times10^4$ Kg/cm$^2$) to about $4.5\times10^5$ psi ($3.2\times10^4$ Kg/cm$^2$), a glass transition temperature (Tg) of between about 50° C. and about 110° C. and a thermal contraction coefficient of between about $6\times10^{-5}$/° C. and about $8\times10^{-5}$/° C.

The thickness of the CTL can be from about 5 micrometers to about 200 micrometers, e.g., from between about 15 micrometers and about 40 micrometers. The CTL may comprise dual layers or multiple layers with different concentration of charge transporting components.

Furthermore, the CTL may also contain inorganic or organic fillers to enhance wear resistance. Inorganic fillers may include, but are not limited to, silica, metal oxides, metal carbonate, metal silicates, and the like. Examples of organic fillers include, but are not limited to, KEVLAR, stearates, fluorocarbon (PTFE) polymers such as POLYMIST and ZONYL, waxy polyethylene such as ACUMIST and ACRAWAX, fatty amides such as PETRAC erucamide, oleamide, and stearamide, and the like. Either micron-sized or nano-sized inorganic or organic particles can be used in the fillers to achieve mechanical property reinforcement.

The Overcoat Layer

Optionally, an overcoat layer 42, if desired, may also be utilized and coated directly over the CTL to provide imaging member surface protection as well as improve resistance to abrasion.

Additional aspects relate to inclusion in the charge transport layer or in an overcoat layer of nanoparticles as a dispersion, such as silica, metal oxides, ACUMIST (waxy polyethylene particles), PTFE, and the like. The nanoparticles may be used to enhance the lubricity and wear resistance of the outermost exposed layer. The particle dispersion is concentrated in the top vicinity of the charge transport layer (up to about 10 weight percent of the weight of or one tenth of the thickness of the charge transport layer) to provide optimum wear resistance without causing a deleterious impact on the electrical properties of the fabricated imaging member. Where an overcoat layer is employed, it may comprise a similar resin used for the charge transport layer or a different resin and be from about 1 to about 2 microns in thickness.

The Anti-Curl Back Coating

A typical ACBC coating or layer 33 of from about 5 to about 50 micrometers in thickness is found to be adequately sufficient for balancing the curl and rendering the imaging member flat. The ACBC layer is optically transparent; it transmits at least about 98 percent of incident light energy through the layer. It also has good adhesion with the substrate. The ACBC of this disclosure may generally have a Young's Modulus in the range of from about $2.0\times10^5$ psi ($1.7\times10^4$ Kg/cm$^2$) to about $4.5\times10^5$ psi ($3.2\times10^4$ Kg/cm$^2$), a glass transition temperature (Tg) of at least 90° C., and/or a thermal contraction coefficient of from about $6\times10^{-5}$/° C. to about $8\times10^{-5}$/° C. to approximately match those properties of the charge transport layer. The ACBC layer of the present disclosure comprises an inner layer 35 and an outer layer 37.

In embodiments, the outer layer comprises a low surface energy polymer and, optionally, another film forming polymer(s). The low surface energy polymer should effectively reduce the surface energy (i.e. increase surface lubricity) of the ACBC layer. In specific embodiments, the low surface energy polymer is a polycarbonate. One particular polymer is a modified bisphenol A polycarbonate commercially available as LEXAN EXL 1414-T from GE Plastics Canada, Ltd (Mississauga, ONTL5N 5P2). This polycarbonate contains poly(dimethylsiloxane) (PDMS) segments in its polymer chain backbone. It has a glass transition temperature (Tg) of 150° C., a coefficient of thermal expansion of $6.6\times10^{-6}$/° C., and a Young's Modulus of $3.2\times10^5$ psi, closely matching those properties of the CTL. The molecular structure of LEXAN EXL 1414-T is provided below in Formula (I):

Formula (I)

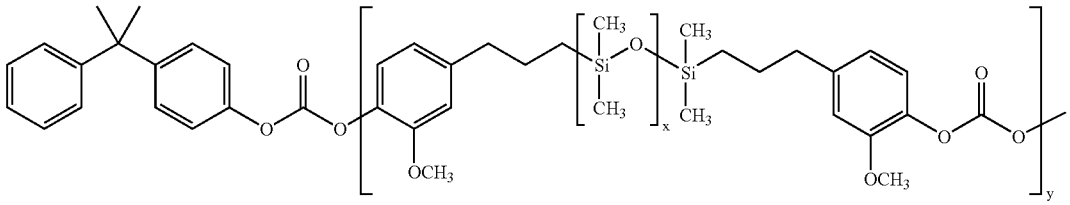

-continued

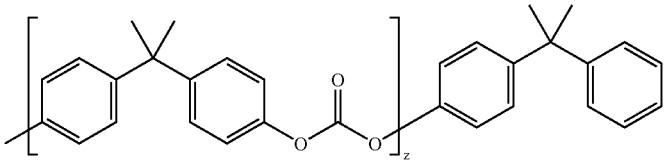

wherein x, y, and z are integers representing the number of repeating units; and x is at least 1. Another suitable low surface energy film forming polymer has the molecular structure provided below in Formula (II):

Formula (II)

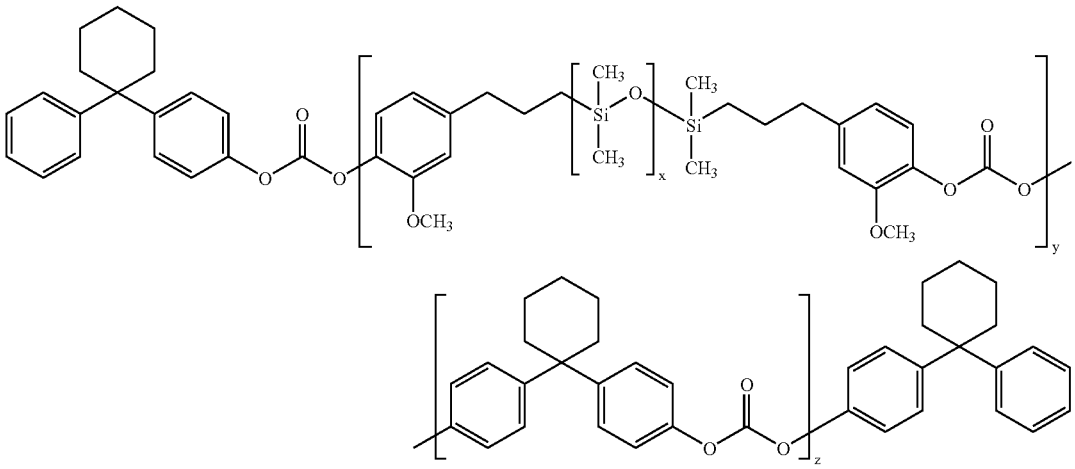

wherein x, y, and z are integers representing the number of repeating units; and x is at least 1.

The low surface energy polymer should contain from about 1 to about 20 weight % of siloxane segments, based on the total weight of the low surface energy polymer. In specific embodiments, it contains from about 2 to about 10 weight % of siloxane segments. In more specific embodiments, it contains from about 2 to about 8 weight % of siloxane segments. The low surface energy polymer has a molecular weight from about 20,000 to about 200,000. In specific embodiments, it has a molecular weight from about 25,000 to about 150,000. The siloxane segments reduce the surface energy of the ACBC layer and thereby increase its surface lubricity. The outer sublayer may have a surface energy of from about 15 to about 30 dynes/cm and/or a coefficient of friction of from about 0.24 to about 0.4, as measured against a metal surface.

In other further embodiments, the low surface energy polymer for the outer layer is a low surface energy copolymer obtained from Mitsubishi Gas Chemical Corporation (Tokyo, Japan), and referred to as FPC0540UA, FPC0550UA, FPC0580UA, and FPC0170UA. These low surface energy polymers are modified Bisphenol A polycarbonate poly(4,4'-isopropylidene diphenyl carbonate) or a modified Bisphenol Z polycarbonate poly (4,4'-diphenyl-1-1'cyclohexane carbonate), having a range of viscosity molecular weights of 39,000 to 76,000 and are readily soluble.

The inner layer or sublayer 35 comprises a film forming polymer which is different from the low surface energy polymer. The film forming polymer is generally the same polymer used in the CTL due to considerations of matching thermal, physical, and mechanical properties. The inner layer may also contain an adhesion promoter. In specific embodiments, the film-forming polymer for the inner layer is a polycarbonate. Polycarbonates having a weight average molecular weight Mw of from about 20,000 to about 250,000 are suitable for use. In specific embodiments, polycarbonates having a Mw of from about 50,000 to about 120,000 are used for forming a coating solution having proper viscosity for easy ACBC 35 application. The electrically inactive polycarbonate candidates suitable for use in the inner layer may include poly(4,4'-dipropylidene-diphenylene carbonate) with a weight average molecular weight (Mw) of from about 35,000 to about 40,000, available as LEXAN 145 from General Electric Company; poly(4,4'-isopropylidene-diphenylene carbonate) with a molecular weight of from about 40,000 to about 45,000, available as LEXAN 141 from the General Electric Company; and a polycarbonate resin having a molecular weight of from about 20,000 to about 50,000 available as MERLON from Mobay Chemical Company.

In one specific embodiment, the film-forming polymer for the inner layer is a bisphenol A polycarbonate of poly(4,4'-isopropylidene diphenyl)carbonate known as MAKROLON, available from Mobay Chemical Company, and having a molecular weight of from about 130,000 to about 200,000. The molecular structure of MAKROLON is given in Formula (III) below:

Formula (III)

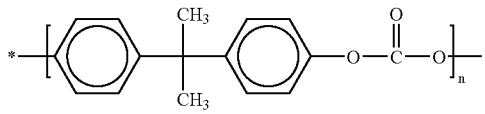

where n indicates the degree of polymerization.

In another specific embodiment, the film-forming polymer is poly(4,4'-diphenyl-1,1'-cyclohexane) carbonate. The molecular structure of poly(4,4'-diphenyl-1,1'-cyclohexane) carbonate, having a $M_w$ of about between about 20,000 and about 200,000, is given in Formula (IV) below:

Formula (IV)

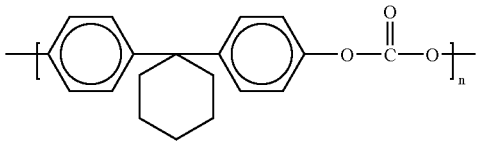

where n indicates the degree of polymerization.

In yet another specific embodiment, the film-forming polymer is a phthalate-polycarbonate represented by the structural Formula (V) below:

Formula (V)

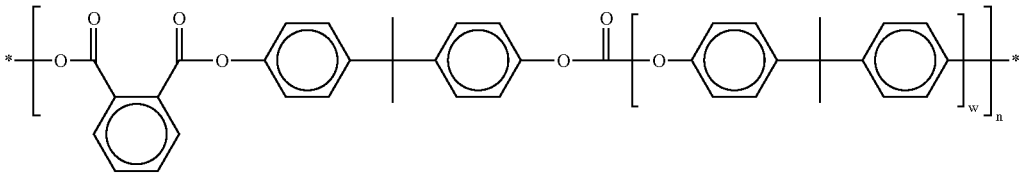

wherein w is an integer from about 1 to about 20, and n is the degree of polymerization.

The inner layer may further comprise an adhesion promoter to enhance bonding of the ACBC layer to the substrate. The adhesion promoter may comprise from about 0.2 to about 30 weight % of the ACBC layer, based on the total weight of the ACBC layer (i.e., including both the top and inner sublayers). In more specific embodiments, it comprises from about 2 to about 10 weight % of the ACBC layer. The adhesion promoter may be any known in the art, such as for example, VITEL PE2200 which is available from Bostik, Inc. (Middleton, Mass.). VITEL PE2200 is a copolyester resin of terephthalic acid and isophthalic acid with ethylene glycol and dimethyl propanediol.

Alternative film forming polymers suitable for the inner layer include polycarbonate, polyester, polyarylate, polyacrylate, polyether, polysulfone, polystyrene, polyamide, and the like, with weight average molecular weight (Mw) varying from about 20,000 to about 250,000.

In some embodiments, the outer layer further comprises the same or different film forming polymer as used in the inner layer. In other embodiments, the outer layer comprises the low surface energy polymer and no other polymers. The outer layer may, however, comprise other additive materials, such as a PTFE particulate dispersion to further reduce wear.

Although the total thickness of the dual or multilayer ACBC layer depends on the thickness of the CTL, it may have a total thickness of from about 5 micrometers to about 50 micrometers to achieve a proper anti-curling effect and keep the imaging member flat. In specific embodiments, the resulting dual or multilayer ACBC layer has a thickness of from about 10 micrometers to about 20 micrometers. The thickness of the outer layer 37 comprising the low surface energy polymer is from about 5 to about 70 percent of the thickness of the inner layer 35. In specific embodiments, the outer layer is from about 15 to about 50 percent the thickness of the inner layer.

The viscosity of a coating solution, containing a low surface energy polymer, suitable for the ACBC ranges from about 20 to about 900 centipoise (cp) when dissolved in a solvent, such as methylene chloride, where the solution is 15 weight percent solid of the total weight of the coating solution. Although the viscosity of this 15 weight percent solution depends on the molecular weight of the polymer, it can also conveniently be adjusted by either changing the concentration of polymers dissolved in the solution or using another solvent.

Any suitable and conventional technique may be utilized to mix all the material components and thereafter apply each sublayer to the substrate to form the ACBC layer of the present disclosure. Typical application techniques include, for example extrusion coating, draw bar coating, roll coating, wire wound rod coating, and the like. Both sublayers may be formed in a single coating step by using a dual coating die process or in multiple coating steps. Drying of the deposited ACBC(s) may be effected by any suitable conventional technique such as oven drying, infrared radiation drying, air drying and the like. The thickness of the resulting ACBC layer after drying depends on the degree of photoconductive imaging member curling caused by the charge transport layer.

Although both FIGS. 2 and 3 illustrate a dual-layer ACBC layer, the present disclosure also encompasses multiples of ACBC layers having more than two layers (i.e., there are intermediate layers present between the outer layer and inner layer). However, the outer layer comprises the low surface energy polymer.

For the creation of electrographic imaging members, a single flexible dielectric layer overlying the conductive layer of a substrate support may be used to replace all the active photoconductive layers. Any suitable, conventional, flexible, electrically insulating, thermoplastic dielectric polymer matrix material may be used in the dielectric layer of the electrographic imaging member. If required, the flexible electrographic belts may use the ACBC coating, comprising a top and inner layers, of this disclosure to provide belt flatness as well as robust mechanical function where cycling durability is important.

An imaging member according to the present disclosure may be imaged by depositing a uniform electrostatic charge on the imaging member; exposing the imaging member to activating radiation in image configuration to form an electrostatic latent image, and developing the latent image with electrostatically attractable marking particles to form a toner image in conformance to the latent image.

The development of the present disclosure will further be illustrated in the following non-limiting working examples. The examples set forth hereinbelow are illustrative of different compositions and conditions that can be used in practicing the invention. All proportions are by weight unless otherwise indicated. It will be apparent, however, that the innovative description can be practiced with many types of compositions and can have many different uses in accordance with the disclosure above and as pointed out hereinafter.

EXAMPLES

Imaging Member Preparation

A conventional flexible electrophotographic imaging member web was prepared by providing a 0.02 micrometer thick titanium layer coated on a substrate of a biaxially oriented polyethylene naphthalate substrate (KADALEX, available from DuPont Teijin Films) having a thickness of 3.5 mils (89 micrometers). The titanized KADALEX substrate was extrusion coated with a blocking layer solution containing a mixture of 6.5 grams of gamma aminopropyltriethoxy silane, 39.4 grams of distilled water, 2.08 grams of acetic acid, 752.2 grams of 200 proof denatured alcohol and 200 grams of heptane. This wet coating layer was then allowed to dry for 5 minutes at 135° C. in a forced air oven to remove the solvents from the coating and form a crosslinked silane blocking layer. The resulting blocking layer had an average dry thickness of 0.04 micrometers as measured with an ellipsometer.

An adhesive interface layer was then extrusion coated by applying to the blocking layer a wet coating containing 5 percent by weight based on the total weight of the solution of polyester adhesive (MOR-ESTER 49,000, available from Morton International, Inc.) in a 70:30 (v/v) mixture of tetrahydrofuran/cyclohexanone. The resulting adhesive interface layer, after passing through an oven, had a dry thickness of 0.095 micrometers.

The adhesive interface layer was thereafter coated over with a charge generating layer. The charge generating layer dispersion was prepared by adding 1.5 gram of polystyrene-co-4-vinyl pyridine and 44.33 gm of toluene into a 4 ounce glass bottle. 1.5 grams of hydroxygallium phthalocyanine Type V and 300 grams of ⅛-inch (3.2 millimeters) diameter stainless steel shot were added to the solution. This mixture was then placed on a ball mill for about 8 to about 20 hours. The resulting slurry was thereafter coated onto the adhesive interface by extrusion application process to form a layer having a wet thickness of 0.25 mils. However, a strip of about 10 millimeters wide along one edge of the substrate web stock bearing the blocking layer and the adhesive layer was deliberately left uncoated by the charge generating layer to facilitate adequate electrical contact by a ground strip layer to be applied later. The wet charge generating layer was dried at 125° C. for 2 minutes in a forced air oven to form a dry charge generating layer having a thickness of 0.4 micrometers.

This coated web stock was simultaneously coated over with a charge transport layer and a ground strip layer by co-extrusion of the coating materials. The charge transport layer was prepared by combining MAKROLON 5705, a Bisphenol A polycarbonate thermoplastic having a molecular weight of about 120,000, commercially available from Farbensabricken Bayer A.G., with a charge transport compound N,N'-diphenyl-N,N'-bis(3-methylphenyl)-[1,1'-biphenyl]-4,4'-diamine in an amber glass bottle in a weight ratio of 1:1 (or 50 weight percent of each).

The resulting mixture was dissolved to give 15 percent by weight solid in methylene chloride. This solution was applied on the charge generating layer by extrusion to form a coating which upon drying in a forced air oven gave a charge transport layer 29 micrometers thick.

The strip, about 10 millimeters wide, of the adhesive layer left uncoated by the charge generating layer, was coated with a ground strip layer during the co-extrusion process. The ground strip layer coating mixture was prepared by combining 23.81 grams of polycarbonate resin (MAKROLON 5705, 7.87 percent by total weight solids, available from Bayer A.G.), and 332 grams of methylene chloride in a carboy container. The container was covered tightly and placed on a roll mill for about 24 hours until the polycarbonate was dissolved in the methylene chloride. The resulting solution was mixed for 15-30 minutes with about 93.89 grams of graphite dispersion (12.3 percent by weight solids) of 9.41 parts by weight of graphite, 2.87 parts by weight of ethyl cellulose and 87.7 parts by weight of solvent (Acheson Graphite dispersion RW22790, available from Acheson Colloids Company) with the aid of a high shear blade dispersed in a water cooled, jacketed container to prevent the dispersion from overheating and losing solvent. The resulting dispersion was then filtered and the viscosity was adjusted with the aid of methylene chloride. This ground strip layer coating mixture was then applied, by co-extrusion with the charge transport layer, to the electrophotographic imaging member web to form an electrically conductive ground strip layer having a dried thickness of about 19 micrometers.

The imaging member web stock containing all of the above layers was then passed through 125° C. in a forced air oven for 3 minutes to simultaneously dry both the charge transport layer and the ground strip. At this point, the imaging member, having a 29-micrometer thick dried charge transport layer, spontaneously curled into a 1.5-inch tube when unrestrained.

Control Example I

A conventionally known ACBC was prepared by combining 88.2 grams of polycarbonate resin (MAKROLON 5705), 7.12 grams VITEL PE-2200 copolyester (available from Bostik, Inc. Middleton, Mass.) and 1,071 grams of methylene chloride in a carboy container to form a coating solution containing 8.9 weight percent solids. The container was covered tightly and placed on a roll mill for about 24 hours until the polycarbonate and polyester were dissolved in the methylene chloride to form the ACBC solution. The ACBC solution contained 8 weight % adhesion promoter and 92 weight % film forming polymer. The ACBC solution was then applied to the rear surface of an imaging member prepared according to the Imaging Member Preparation by extrusion coating and dried to a maximum temperature of 125° C. in a forced air oven for 3 minutes to produce a dried ACBC layer having a thickness of 17 micrometers and flatten the imaging member.

Control Example II

Another known ACBC was prepared by combining 88.2 grams of polycarbonate resin (MAKROLON 5705), 7.12 grams VITEL PE-2200 copolyester (available from Bostik, Inc. Middleton, Mass.), nano particles PTFE dispersion, and 1,071 grams of methylene chloride in a carboy container to form a coating solution containing 8.9 weight percent polymers in methylene chloride based only on the weight of methylene chloride and polymers. The ACBC solution was then applied to the rear surface of an imaging member prepared according to the Imaging Member Preparation by extrusion coating and dried to a maximum temperature of 125° C. in a forced air oven for 3 minutes to produce a dried ACBC layer having a thickness of 17 micrometers and flatten the imaging member. The resulting dried anti-curl back coating contained 10 weight percent PTFE dispersion.

Disclosure Example

An imaging member was made according to the Imaging Member Preparation described above. An ACBC dual-layer of the present disclosure was applied to the backside. The inner sublayer had the same material composition as that of Control Example I and was 14 micrometers thick. The outer sublayer was 3 micrometers thick and comprised 100% low surface energy polymer GE LEXAN EXL1414-T polycarbonate (available from GE Plastics). The resulting ACBC layer was 17 micrometers thick and rendered the imaging member flat.

Physical and Mechanical Property Determination

The ACBC layers of the Control Examples and the Disclosure Example were each assessed for their surface energy, coefficient of surface contact friction, and peel strength. The surface energy was determined by liquid contact angle measurement. The coefficient of surface contact friction was measured by dragging the surface of each ACBC layer against the top of a smooth metal stainless steel plate. The peel strength was conducted by the 180° adhesive tape (using 3M Scotch Tape) peel test method, by determining the peeling force required to peel the tape off from each ACBC surface, to access the abhesiveness of the surface. The results are listed below in Table 1.

TABLE 1

| ACBC Formulation | Surface Energy (dynes/cm) | Coefficient of Friction | Tape Peel Strength (gm/cm) |
|---|---|---|---|
| Control Example I (MAKROLON) | 40 | 0.48 | 210 |
| Control Example II (Makrolon plus PTFE dispersion) | 40 | 0.40 | 190 |
| Disclosure Example (Dual-layer ACBC) | 21 | 0.31 | 33 |

The results indicate that the low surface energy film forming polymer was suitable for use as the ACBC of an imaging member belt. It had low surface energy and a low coefficient of friction. The significant reduction in peel strength positively indicated that the ACBC had a low propensity of causing electrostatic charge build-up, increasing wear resistance and easing belt transport over its supports. Furthermore, the ACBCs of the Disclosure Example adhered to the substrate as well as the ACBC of the Control Examples.

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace and encompass all such alternatives, modifications variations, improvements, and substantial equivalents.

The invention claimed is:

1. An imaging member comprising:

an anti-curl back coating;

a substrate having a front side and a back side;

an electrically conductive layer when the substrate is not electrically conductive;

a charge generating layer; and a charge transport layer;

wherein the electrically conductive layer, charge generating layer, and charge transport layer are located on the front side of the substrate;

wherein the anti-curl back coating is located on the back side of the substrate and comprises an inner layer, an outer layer, and intermediate layers between the outer layer and inner layer;

the outer layer comprising a low surface energy polymer having siloxane segments in its backbone, the low surface energy polymer having the structure of Formulas (I) or (II)

Formula (I)

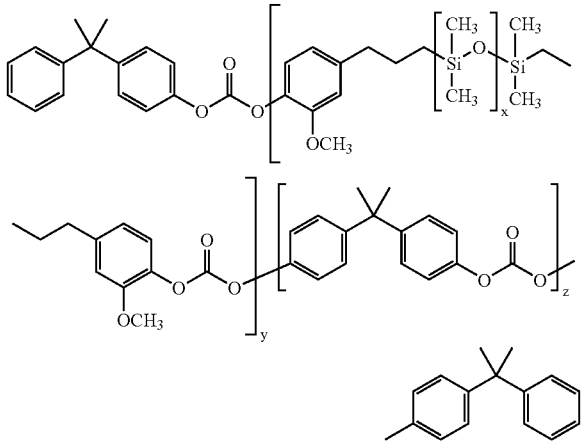

Formula (II)

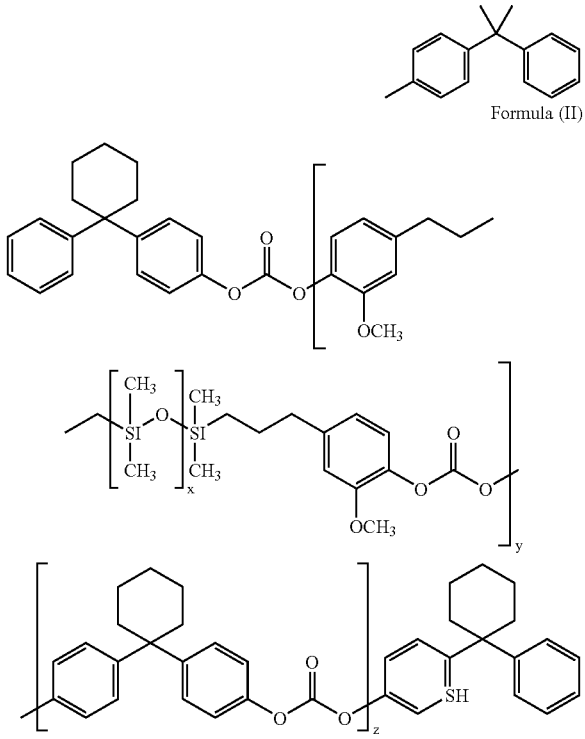

wherein x, y, and z are integers representing the number of repeating units; and x is at least 1; and the inner layer comprising a film forming polymer different from the low surface energy polymer.

2. An imaging member comprising:

an anti-curl back coating;

a substrate having a front side and a back side;

an electrically conductive layer when the substrate is not electrically conductive;

a charge generating layer; and a charge transport layer;

wherein the electrically conductive layer, charge generating layer, and charge transport layer are located on the front side of the substrate;

wherein the anti-curl back coating is located on the back side of the substrate and comprises an inner layer and an outer layer;

the outer layer comprising a low surface energy polymer having siloxane segments in its backbone, the low surface energy polymer having the structure of Formulas (I) or (II)

Formula (I)
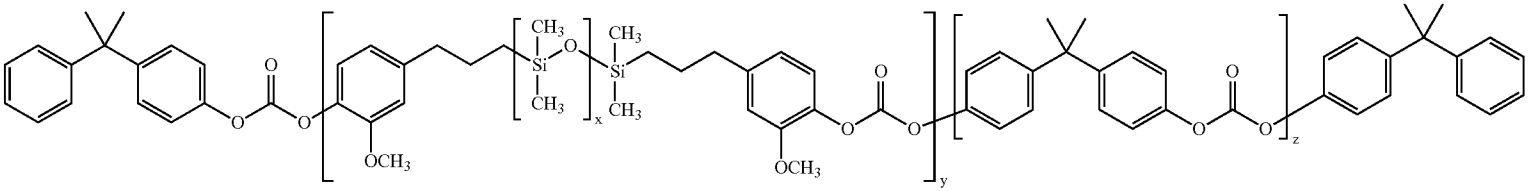
Formula (II)
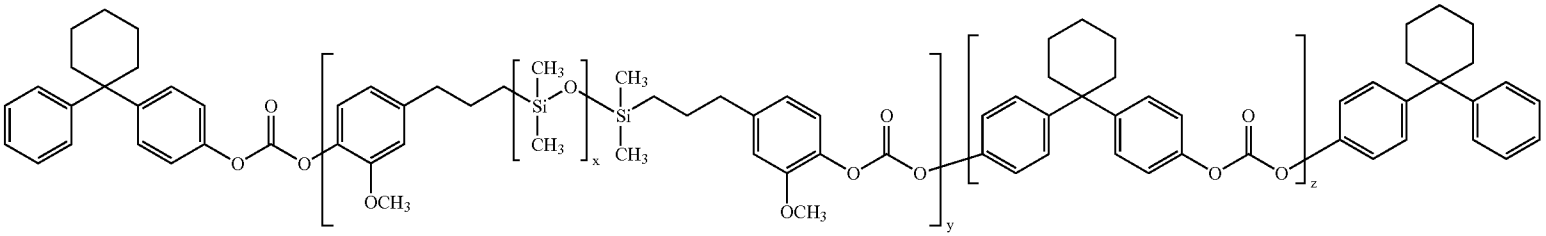

wherein x, y, and z are integers representing the number of repeating units: and x is at least 1; and the inner layer comprising a film forming polymer different from the low surface energy polymer;

wherein the outer layer further comprises a film forming polymer which is the same as the film forming polymer of the inner layer.

3. An imaging member comprising:

an anti-curl back coating;

a substrate having a front side and a back side;

an electrically conductive layer when the substrate is not electrically conductive;

a charge generating layer; and a charge transport layer;

wherein the electrically conductive layer, charge generating layer, and charge transport layer are located on the front side of the substrate and the anti-curl back coating is located on the back side of the substrate;

wherein the anti-curl back coating comprises an inner layer and an outer layer:

the outer layer is a polymer blend and comprises a low surface energy polymer having the structure of Formula (I) or Formula (II):

Formula (I)
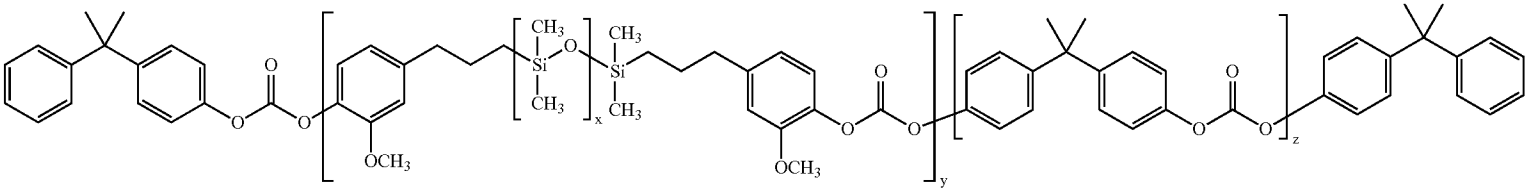
Formula (II)
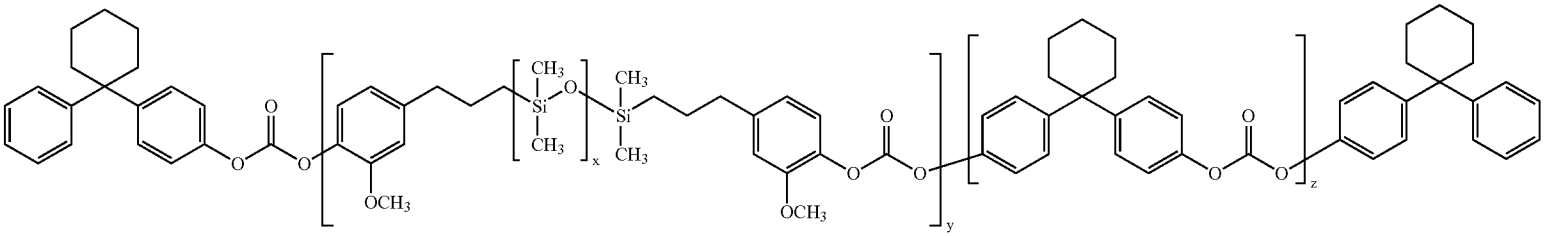

wherein x, y, and z are integers representing the number of repeating units; and x is at least 1;

and the inner layer comprises a film forming polymer having the structure of Formula (III), Formula (IV), or Formula (V):

Formula (III)

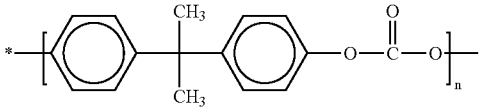

Formula (IV)

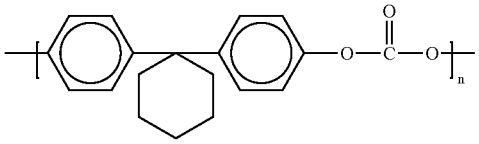

Formula (V)

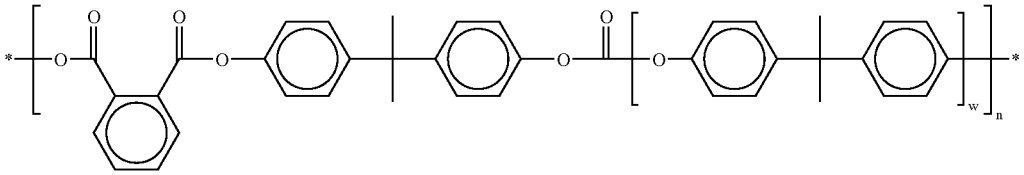

wherein w is an integer from about 1 to about 20, and n is the degree of polymerization.

4. An image forming apparatus for forming images on a recording medium comprising:

a) an electrophotographic imaging member having a charge retentive-surface to receive an electrostatic latent image thereon, wherein the electrophotographic imaging member comprises a substrate; an electrically conductive layer when the substrate is not electrically conductive; a charge generating layer; and, a charge transport layer on one side of the substrate; and an anti-curl back coating on the opposite side of the substrate, wherein the anti-curl back coating comprises an inner layer back coating on the opposite side of the substrate, and an outer layer, the outer layer comprising a low surface energy polymer having siloxane segments in its backbone, the low surface energy polymer having the structure of Formulas (I) or (II)

Formula (I)
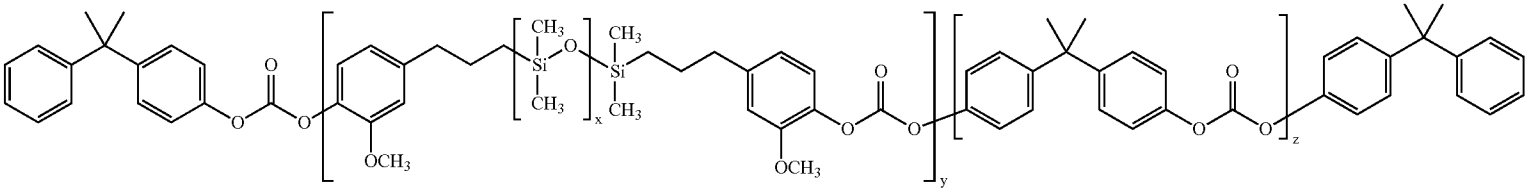
Formula (II)
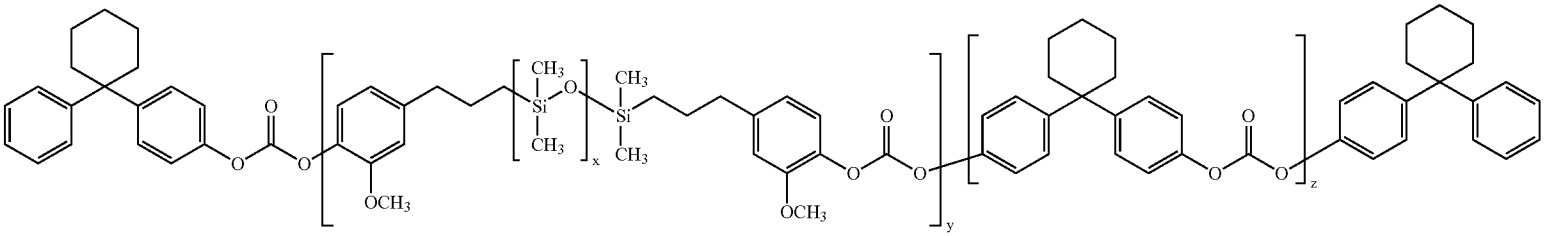

wherein x, y, and z are integers representing the number of repeating units; and x is at least 1; and the inner layer comprising a film forming polymer which is different from the low surface energy polymer;

b) a development component to apply a developer material to the charge-retentive surface to develop the electrostatic latent image to form a developed image on the charge-retentive surface;

c) a transfer component for transferring the developed image from the charge-retentive surface to another member or a copy substrate; and, d) a fusing member to fuse the developed image to the copy substrate.

* * * * *